US007897889B2

(12) United States Patent
Chikahisa et al.

(10) Patent No.: US 7,897,889 B2
(45) Date of Patent: Mar. 1, 2011

(54) MOVABLE CONTACT ELEMENT AND SWITCH USING THE SAME

(75) Inventors: Yousuke Chikahisa, Hyogo (JP); Koji Tanabe, Osaka (JP)

(73) Assignee: Panasonic Corporation, Osaka (JP)

( * ) Notice: Subject to any disclaimer, the term of this patent is extended or adjusted under 35 U.S.C. 154(b) by 282 days.

(21) Appl. No.: 12/116,449

(22) Filed: May 7, 2008

(65) Prior Publication Data

US 2008/0296135 A1 Dec. 4, 2008

(30) Foreign Application Priority Data

Jun. 1, 2007 (JP) ..... 2007-146416

(51) Int. Cl.
*H01H 9/00* (2006.01)

(52) U.S. Cl. ..... 200/314; 200/516

(58) Field of Classification Search ..... 200/314
See application file for complete search history.

(56) References Cited

U.S. PATENT DOCUMENTS 5,664,667 A * 9/1997 Kenmochi ..... 200/314

FOREIGN PATENT DOCUMENTS

JP 2004-022374 A 1/2004
JP 2006-318905 11/2006

* cited by examiner

*Primary Examiner*—Renee Luebke
*Assistant Examiner*—Lisa Klaus
(74) *Attorney, Agent, or Firm*—Pearne & Gordon LLP

(57) ABSTRACT

A movable contact element including a lower sheet having a bottom surface, to which a substantially dome-shaped movable contact is bonded, is provided. The movable contact is made of a conductive thin metal plate, and an upper sheet with a light reflection property is disposed above the lower sheet. A space is formed between the lower sheet and the upper sheet, and a light transmitting portion is provided at the upper sheet. Light of a light emitting element from the side surface of the sheet propagates through the space between the upper sheet and the lower sheet with a light reflection property, while being reflected in a vertical direction, and lighting is performed through the light transmitting portions. Such a structure can perform lighting without unevenness by using one or two light emitting elements.

8 Claims, 5 Drawing Sheets

MOVABLE CONTACT ELEMENT AND SWITCH USING THE SAME

FIELD OF THE INVENTION

The present invention relates to a movable contact used for operating various electronic apparatuses and a switch using the same.

BACKGROUND ART

Recently, light emitting diodes or EL elements are mounted in various electronic apparatuses, specifically mobile terminals such as mobile phones. The light emitting diodes or EL elements emit light so as to light an operation portion such that the operation or identification of pushbutton or display sheet is easily performed even when the surrounding is dark. Further, there is demand for a movable contact element and switch which are easy to use and are inexpensive.

Such a conventional movable contact element and switch using the same will be described with reference to FIGS. 5 and 6. In the drawings, the thicknesses of layers and regions are exaggerated for clarity. FIG. 5 is a cross-sectional view of a conventional switch. FIG. 6 is an exploded perspective view of essential parts of the switch. In FIGS. 5 and 6, film-shaped light guiding sheet 1, which is optically transparent and has flexibility, has a light guiding layer 1A whose top and bottom surfaces are interposed between upper protective layer 1B and lower protective layer 1C. A plurality of movable contacts 3, which are formed in substantially a dome shape and are made of a conductive metal thin plate, are bonded to the bottom surface of light guiding sheet 1 through an adhesive (not shown). Light guiding layer 1A above movable contact 3 has a plurality of light emitting portions 1D formed in an irregular shape. In such a manner, movable contact element 4 is constructed.

Substrate 5 having a plurality of wiring patterns (not shown) formed on the top and bottom surfaces thereof has a plurality of fixed contacts 6 formed on the top surface thereof, the fixed contacts 6 being composed of circular central fixed contact 6A and U-shaped outer fixed contacts 6B surrounding central fixed contact 6A. The outer circumference of movable contact 3 is placed on outer fixed contacts 6B such that the center of the bottom surface of movable contact 3 faces central fixed contact 6A with a predetermined space provided therebetween. A plurality of light emitting elements 7 composed of light emitting diodes and so on are mounted on substrate 5 in the right side of light guiding sheet 1 such that the light emitting surfaces thereof face the right side surface of light guiding layer 1A of light guiding sheet 1. Sheet-shaped operation body 8 made of insulating resin is composed of light transmitting portion 8A and light shielding portion 8B covering the top surface of light transmitting portion 8A. On the top surface of a plurality of operation portions 8C, a display portion 8D is provided, through which light transmitting portion 8A is exposed in a character or sign shape. Pressing portion 8E projecting downward is abutted on the top surface of light guiding sheet 1 at the central portion of movable contact 3. The conventional switch is constructed in the above-described manner. The switch constructed in such a manner is mounted on the operation surface of an electronic apparatus, central fixed contact 6A or outer fixed contacts 6B and light emitting elements 7 are connected to electronic circuits (not shown) of the apparatus through wiring patterns by a connector or lead lines (not shown).

In the above-described construction, when predetermined operation portion 8C of operation body 8 is pressed downward, pressing portion 8E provided on the bottom surface of operation portion 8C presses the top surface of light guiding sheet 1. Then, light guiding sheet 1 is bent to press the substantially dome-shaped central portion of movable contact 3. When a predetermined pressing force is applied, movable contact 3 is elastically inverted downward with a click feeling such that the center of the bottom surface of movable contact 3 comes in contact with central fixed contact 6A. Then, central fixed contact 6A and outer fixed contacts 6B are electrically connected through movable contact 3.

When the pressing force applied to the operation portion 8C is released, movable contact 3 is elastically inverted upward by an elastic restoring force, and the center of the bottom surface is separated from central fixed contact 6A such that central fixed contact 6A is electrically disconnected from outer fixed contacts 6B.

Further, depending on the electrical connection and disconnection of fixed contact 6, the switching of the respective functions in the apparatus is performed. Further, when a voltage is applied to light emitting element 7 from an electric circuit of the apparatus, light emitting element 7 emits light. The light is incident on light guiding layer 1A from the right side surface of light guiding sheet 1 such that the entire body of light guiding layer 1A is lighted. The light is reflected by light emitting portions 1D within light guiding layer 1A, which are formed in an irregular shape. Further, light emitting portions 1D emit light. Then, the light passes through upper protective layer 1B so as to light display portion 8D of operation body 8 from the lower side. Therefore, even when the surrounding is dark, the display of characters or signs of operation portion 8C can be recognized, which makes it easy to perform an operation. Further, as a prior art document relating to the invention, Japanese Patent Unexamined Publication No. 2006-318905 is known.

In the conventional movable contact and the switch using the same, light from light emitting element 7 is distributed on the entire portion of light guiding layer 1A of light guiding sheet 1 such that the plurality of display portions 8D of operation portion 8 are lighted. However, light emitting portions 1D distant from light emitting element 7 become so dark that unevenness occurs in the lighting. To reduce the unevenness and perform uniform lighting, a large number of lighting elements 7 need to be disposed around light guiding sheet 1. Then, the construction of the switch becomes complicated, and the price thereof increases.

SUMMARY OF THE INVENTION

An advantage of the present invention is that it provides a movable contact element which has a predetermined space formed between a lower sheet having a bottom surface to which a substantially dome-shaped movable contact made of a conductive thin metal plate is bonded and an optically-reflexive upper sheet disposed above the lower sheet. Further, light transmitting portions are provided in the upper sheet above the movable contact. When a switch is formed, light from a light emitting element is vertically reflected in the space between the upper sheet and the lower sheet both of which have light reflection properties, and lighting is performed through the light transmitting portions. Therefore, uniform lighting without unevenness can be performed by one or two light emitting elements. That is, it is possible to obtain a movable contact element whose construction is simple and the price is low.

DETAILED DESCRIPTION OF THE INVENTION

Figure 1:
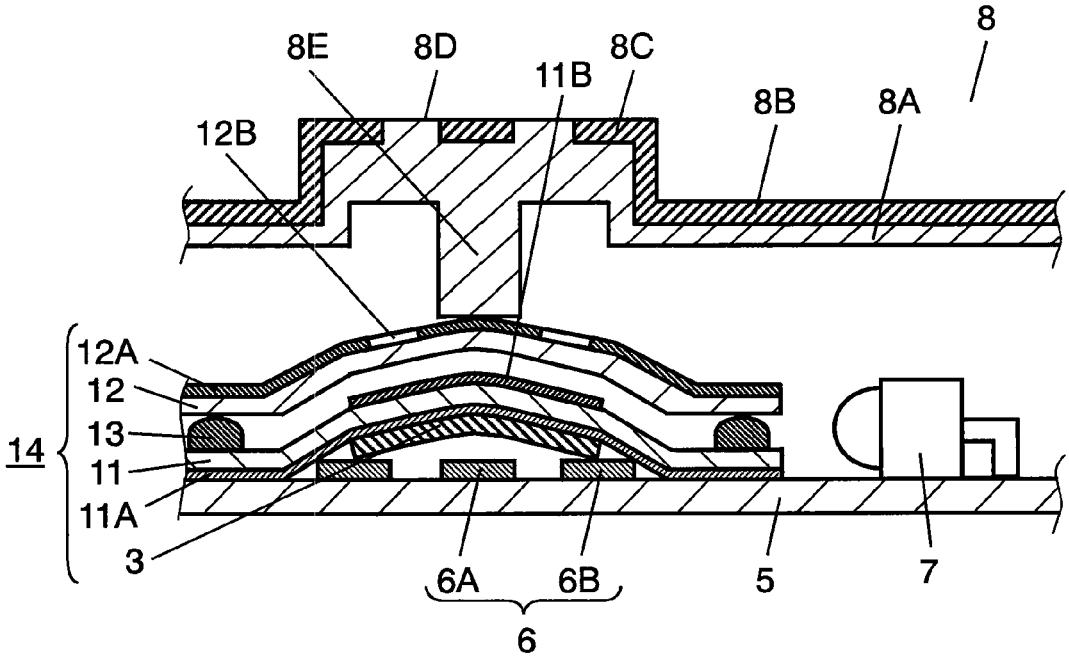
FIG. 1 is a cross-sectional view of a switch according to an embodiment of the present invention.

Preferred embodiments of the present invention will now be described with reference to FIGS. 1 to 4. In the drawings, the thicknesses of layers and regions are exaggerated for clarity. Further, like reference numerals will be attached to the same components as those described in Background Art, and the detailed descriptions thereof will be omitted.

Embodiment

Figure 2:
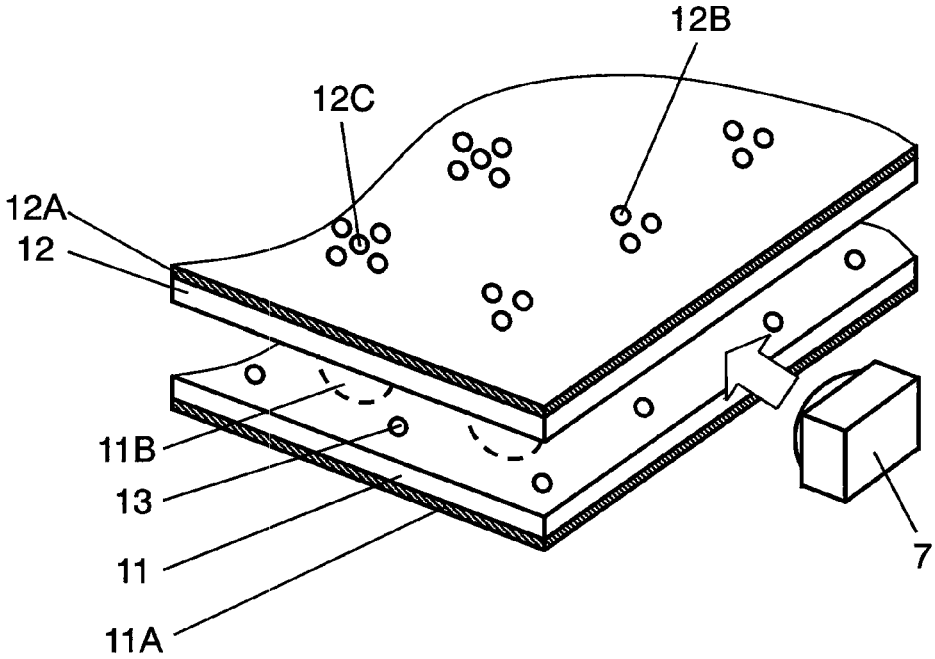
FIG. 2 is an exploded perspective view of essential parts of the switch according to the embodiment of the invention.

FIG. 1 is a cross-sectional view of a switch according to an embodiment of the invention. FIG. 2 is an exploded perspective view of essential parts of the switch. In FIGS. 1 and 2, optically-transparent lower sheet 11 composed of polyethylene terephthalate or polycarbonate is formed in a film shape with a thickness of about 5 to 200 μm, preferably, about 25 to 100 μm. On the bottom surface of lower sheet 11, light reflection layer 11A obtained by dispersing scale-shaped aluminum or silver into transparent resin such as polyester or epoxy is printed with a thickness of about 0.1 to 10 μm. Movable contact 3 is made of a conductive thin metal plate, such as a copper alloy or silver, which is formed in substantially a dome shape. The plurality of movable contacts 3 are bonded to the bottom surface of lower sheet 11 through an adhesive (not shown) such as acrylic resin, silicon, or butyl rubber. On the top surface of lower sheet 11 above movable contact 3, light diffusion layer 11B obtained by dispersing white pigment or hollow glass beads into transparent resin is printed.

Similar to lower sheet 11, optically-transparent upper sheet 12 has light reflection layer 12A printed on the top surface thereof. On the top surface of lower sheet 11, a plurality of dot spacers 13 composed of polyester or epoxy are formed at the outer circumference of movable contact 3 such that upper sheet 12 is disposed above lower sheet 11 with a space of about 10 to 200 μm formed therebetween.

Light reflection layer 12A of upper sheet 12 above movable contact 3 has a plurality of hole-shaped light transmitting portions 12B formed therein, light transmitting portions 12B being spaced at a distance of about 0.5 mm from each other and having a diameter of about 0.1 to 0.5 mm.

In the vicinity of light transmitting portions 12B, upper sheet 12 is swollen upward, while the thickness thereof is maintained as it is. A portion of lower sheet 11 corresponding to the swollen portion of upper sheet 12 is swollen upward, while the thickness thereof is maintained as it is. In such a manner, movable contact element 14 is constructed.

Figure 3:
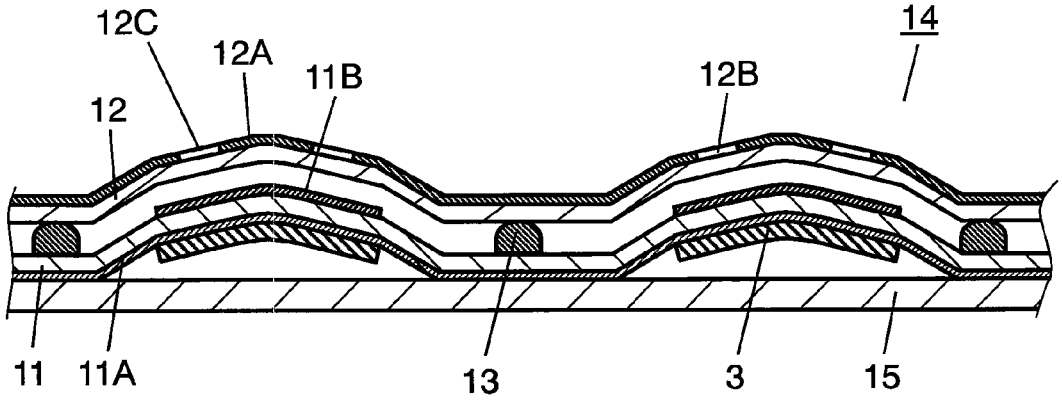
FIG. 3 is a cross-sectional view of a movable contact element of the switch according to the embodiment of the invention.

FIG. 3 is a cross-sectional view of the movable contact element. As shown in FIG. 3, film-shaped separator 15 composed of polyethylene terephthalate or paper is bonded to the bottom surface of lower sheet 11 in movable contact element 14, and the bottom surface of movable contact 3 is covered by separator 15. Therefore, storage and transport are performed in such a manner that dust and oil does not adhere to movable contact 3.

In FIG. 1, substrate 5 is formed of a film which is composed of polyethylene terephthalate or polycarbonate, or is formed of a plate which is composed of paper phenol or glass-containing epoxy. Substrate 5 has a plurality of wiring patterns (not shown) formed on the top and bottom surfaces thereof, the wiring patterns being composed of copper. Further, substrate 5 has a plurality of fixed contacts 6 provided thereon, fixed contacts 6 being composed of substantially circular central fixed contact 6A and U-shaped outer fixed contacts 6B surrounding central fixed contact 6A. Fixed contacts 6 are composed of copper or carbon. On the top surface of substrate 5, movable contact element 14 from which separator 15 is peeled off is loaded in such a manner that the outer circumference of each movable contact 3 is placed on outer fixed contacts 6B. Further, movable contact element 14 is bonded in such a manner that the center of the bottom surface thereof faces central fixed contact 6A with a predetermined space provided therebetween. Light emitting element 7 such as a light emitting diode or the like is mounted on substrate 5 in the right side of movable contact element 14, and is disposed in such a manner that the light emitting surface thereof faces the space between upper and lower sheets 12 and 11. Sheet-shaped operation body 8 made of insulating resin is composed of light transmitting portion 8A and light shielding portion 8B covering the top surface of light transmitting portion 8A. On the top surface of a plurality of operation portions 8C, display portion 8D through which light transmitting portion 8A is exposed in a character or sign shape is provided. Further, pressing portion 8E projecting downward is abutted on the top surface of upper sheet 12 in the center of movable contact 3. The switch is constructed in the above-described manner.

The switch constructed in such a manner is mounted on the operation surface of an electronic apparatus, and central fixed contact 6A or outer fixed contacts 6B and light emitting element 7 are connected to electric circuits (not shown) of the electronic apparatus through the wiring patterns by a connector or lead lines (not shown).

In above-described construction, when predetermined operation portion 8C of operation body 8 is pressed downward, pressing portion 8E formed on the bottom surface of operation portion 8C presses the top surface of upper sheet 12. Then, upper and lower sheets 12 and 11 are bent to press the substantially dome-shaped central portion of movable contact 3. When a predetermined pressing force is applied, movable contact 3 is elastically inverted downward with a click feeling such that the center of the bottom surface of movable contact 3 comes in contact with central fixed contact 6A. Then, central fixed contact 6A and outer fixed contacts 6B are electrically connected through movable contact 3.

When the pressing force applied to the operation portion 8C is released, movable contact 3 is elastically inverted upward by an elastic restoring force, and the center of the bottom surface thereof is separated from central fixed contact 6A such that central fixed contact 6A and outer fixed contacts 6B are electrically disconnected.

Figure 4:
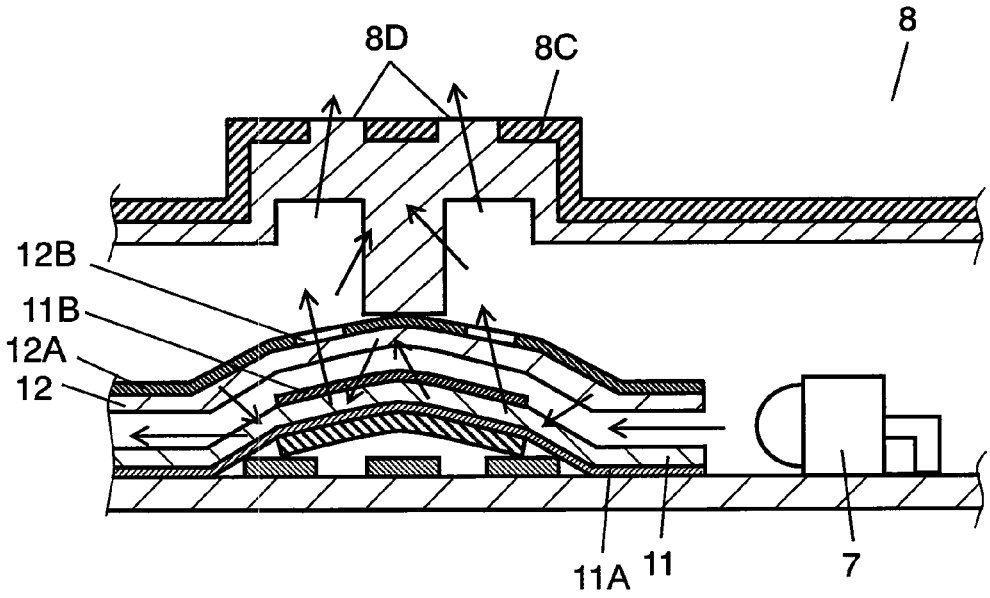
FIG. 4 is an expanded cross-sectional view of the switch according to the embodiment of the invention.
Figure 5:
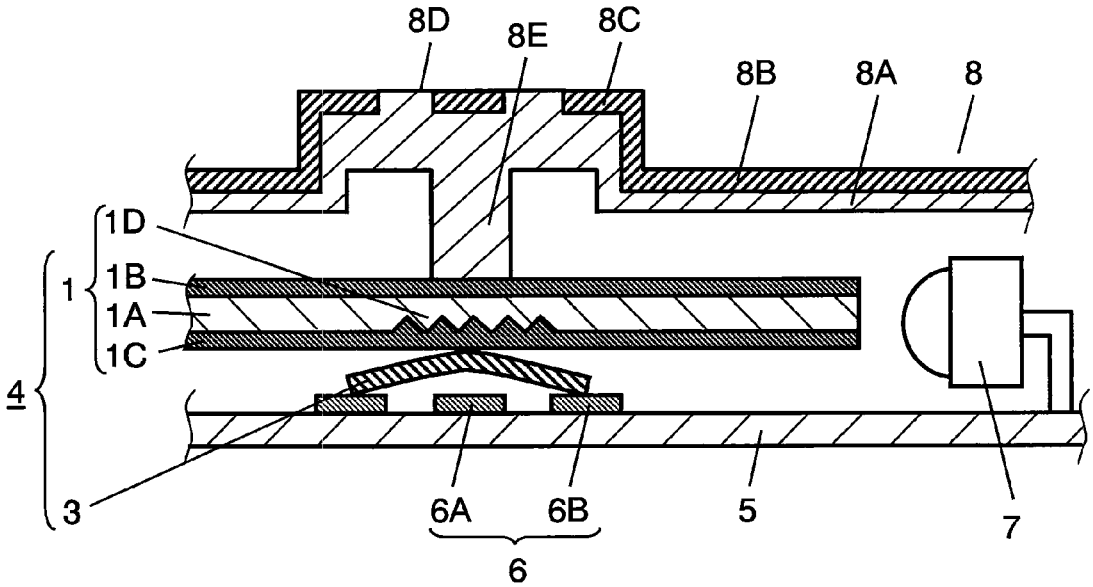
FIG. 5 PRIOR ART
FIG. 5 is a cross-sectional view of a conventional switch.
Figure 6:
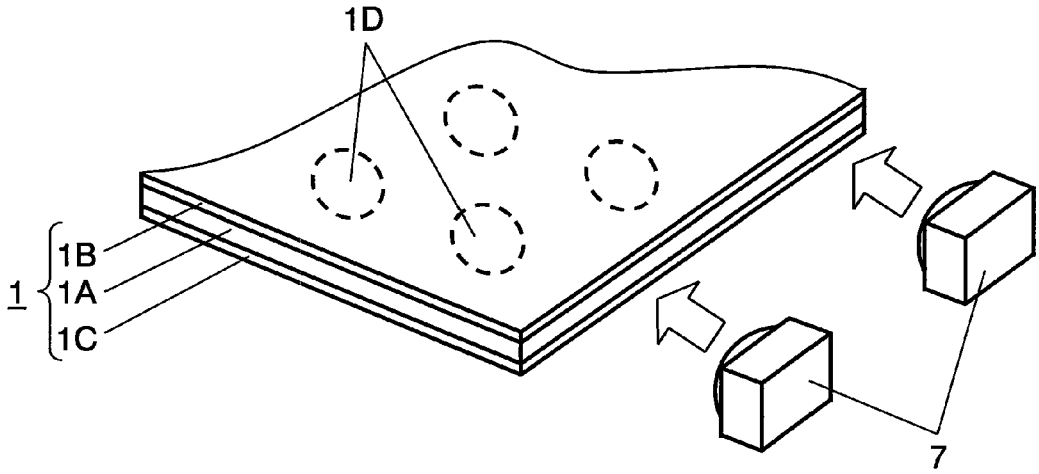
FIG. 6 PRIOR ART
FIG. 6 is an exploded perspective view of essential parts of the conventional switch.

Depending on the electrical connection and disconnection of fixed contact 6, the switching of the respective functions of the apparatus is performed. Further, when a voltage is applied to light emitting element 7 from an electric circuit of the apparatus, light emitting element 7 emits light. The light is incident on the space between upper and lower sheets 12 and 11 of movable contact element 14. FIG. 4 is an expanded cross-sectional view of the switch when the light is incident on the space. As shown in FIG. 4, the light propagates straight in the space. Alternately, the light propagates through the space while being reflected by light reflection layer 11A provided on the bottom surface of lower sheet 11 or light reflection layer 12A provided on the top surface of upper sheet 12.

As the lights are irregularly reflected by light diffusion layer 11B, the lights are further diffused so as to be emitted from the plurality of hole-shaped light transmitting portions 12B. Then, display portion 8D of operation body 8 is lighted by the lights from the lower side. Therefore, even when the surrounding is dark, the display of characters or signs on operation portion 8C can be recognized, which makes it easy to perform an operation.

Since upper and lower sheets 12 and 11 are swollen upward in the vicinity of light transmitting portion 12B, light easily collides with lower sheet 11 at corresponding light transmitting portion 12B. Therefore, the light colliding with lower sheet 11 is more effectively emitted upward from light transmitting portion 12B.

At this time, the light from light emitting element 7 does not propagate through a film such as polyethylene terephthalate or a layer such as polyester resin whose refractive index is high, but propagates straight in the space between upper and lower sheets 12 and 11, that is, in the air whose refractive index is low. Alternately, the light propagates while being reflected in a vertical direction by light reflection layer 11A or 12A. Therefore, the degradation of brightness is small. In other words, the absorption of light is so small that the light can propagate a long way without any loss. Therefore, display portion 8D located at a place separated from light emitting element 7 can be brightly lighted without unevenness.

In this embodiment, the space is formed between upper and lower sheets 12 and 11 with a light reflection property, and light from light emitting element 7 is reflected in the space. Further, the reflected light is guided upward from light transmitting portion 12B. Therefore, uniform lighting without unevenness can be performed with respect to the plurality of display portions 8D by a simple unit using one or two light emitting elements 7.

Further, although lower sheet 11 is replaced with a typical optically-transparent sheet with no reflection film, light is reflected by the sheet to some degree. As described above, however, light reflection layer 11A is provided on the bottom surface of lower sheet 11, and both upper and lower sheets 12 and 11 are formed to have a light reflection property. Then, it is possible to perform brighter lighting without unevenness.

As shown in FIG. 2, light transmitting portions 12B with a small number of holes are provided at a place close to light emitting element 7, and light transmitting portions 12C with a large number of holes are provided at a place which is separated from light emitting element 7 and in which light becomes weak. Therefore, the area of the light transmitting portion from which light is emitted, that is, the brightness of lighting can be varied, so that the plurality of display portions 8D of operation body 8 can be lighted at uniform brightness without unevenness.

Further, when the end portions of lower sheet 11 and upper sheet 12 excluding the places on which light from light emitting element 7 is incident are bonded and sealed by an adhesive or thermal compression bonding, the light can be prevented from leaking to the outside. Therefore, it is possible to perform brighter and more uniform lighting.

In this embodiment, the predetermined space is formed between lower sheet 11 to which substantially dome-shaped movable contact 3 made of a conductive thin metal plate is bonded and light-reflecting upper sheet 12 disposed above lower sheet 11. Further, light transmitting portions 12B are provided in upper sheet 12 above movable contact 3. Accordingly, light from light emitting element 7 propagates through the space between upper and lower sheets 12 and 11 with a light reflection property while being reflected in a vertical direction, and lighting is performed through light transmitting portions 12B. Therefore, the lighting can be performed by one or two light emitting elements without unevenness. Simultaneously, it is possible to obtain an inexpensive movable contact element with a simple structure and a switch using the movable contact element.

In this embodiment, it has been described that light reflection layers 11A and 12A are printed on the bottom surface of lower sheet 11 and the top surface of upper sheet 12, respectively. However, although the respective sheets are plated with aluminum, silver, or copper such that upper and lower sheets 12 and 11 has a light reflection property, the embodiment of the invention can be implemented. When light reflection layer 11A or 12A is provided by the plating, a light reflection layer may be formed on the top surface of lower sheet 11 or the bottom surface of upper sheet 12, reverse to the above-described construction. In this case, since the respective sheets also have a light reflection property, it is possible to obtain the same operation and effect.

Instead of light reflection layer 11A or 12A, white pigment or dye may be dispersed into lower or upper sheet 11 or 12 such that lower or upper sheet 11 or 12 has a light reflection property, even though brightness is reduced.

In the above embodiment, it has been described that the plurality of dot spacers 13 are provided on the top surface of lower sheet 11 at the outer circumference of movable contact 3 such that the predetermined space is formed between lower sheet 11 and upper sheet 12. However, although the plurality of dot spacers 13 is provided on the bottom surface of upper sheet 12, the embodiment of the invention can be implemented. Further, the plurality of dot spacers 13 may be formed on the top surface of lower sheet 11 or the bottom surface of upper sheet 12 above movable contact 3 such that a space is provided therebetween.

The movable contact element and the switch using the same according to the invention can perform uniform lighting without unevenness and can be utilized for operating various electronic apparatuses with simple arrangement. Further, the movable contact element and the switch can be manufactured at a low cost.

What is claimed is:

1. A movable contact element comprising:

a lower sheet having a bottom surface to which a substantially dome-shaped movable contact is bonded, the movable contact being made of a conductive thin metal plate; and an upper sheet with a light reflection property that is disposed above the lower sheet, wherein a space is formed between the lower sheet and the upper sheet, and a light transmitting portion is provided at the upper sheet above the movable contact, wherein the upper sheet has a substantially dome-shaped portion corresponding to the substantially dome-shaped movable contact.

2. The movable contact element according to claim 1, wherein the lower sheet is formed to have a light reflection property.

3. The movable contact element according to claim 1, wherein a light diffusion layer is provided so as to face the space above the movable contact.

4. The movable contact element according to claim 1, wherein the upper sheet and the lower sheet are swollen upward in the vicinity of the light transmitting portions.

5. A switch comprising:

the movable contact element according to claim 1 bonded to a top surface of a substrate having a fixed contact formed on the top surface thereof, the fixed contact facing the movable contact.

6. The movable contact element according to claim 1, wherein the light transmitting portion comprises a hole formed in the upper sheet.

7. The movable contact element according to claim 1, wherein the movable contact element has an end portion light-receiving from a light emitting element;

the movable contact is one of a plurality of movable contacts, the plurality of movable contacts include a first movable contact and a second movable contact distant to the end portion more than the first movable contact;

the light transmitting portion is one of a plurality of light transmitting portions, the plurality of light transmitting portions include a first light transmitting portion disposed at a position of corresponding to the first movable contact and a second light transmitting portion disposed at a position of corresponding to the second movable contact; and an area of the second light transmitting portion is larger than an area of the first light transmitting portion.

8. A movable contact element comprising:

a lower sheet having a bottom surface to which a substantially dome-shaped movable contact is bonded, the movable contact being made of a conductive thin metal plate; and an upper sheet with a light reflection property that is disposed above the lower sheet, wherein a space is formed between the lower sheet and the upper sheet, and a plurality of light transmitting portions are provided at the upper sheet above the movable contact, wherein the upper sheet has a substantially dome-shaped portion corresponding to the substantially dome-shaped movable contact.

* * * * *